US009409284B2

(12) United States Patent
Sun

(10) Patent No.: US 9,409,284 B2
(45) Date of Patent: Aug. 9, 2016

(54) RATCHET HANDLE

(71) Applicant: SHANGHAI EASY-USE TOOLS ENTERPRISE CO. LTD., Shanghai (CN)

(72) Inventor: Shiyu Sun, Shanghai (CN)

(73) Assignee: SHANGHAI EASY-USE TOOLS ENTERPRISE CO. LTD., Shanghai (CN)

( * ) Notice: Subject to any disclaimer, the term of this patent is extended or adjusted under 35 U.S.C. 154(b) by 287 days.

(21) Appl. No.: 13/984,006

(22) PCT Filed: May 20, 2013

(86) PCT No.: PCT/CN2013/075883

§ 371 (c)(1),
(2) Date: Apr. 29, 2014

(87) PCT Pub. No.: WO2014/153818

PCT Pub. Date: Oct. 2, 2014

(65) Prior Publication Data

US 2014/0290442 A1 Oct. 2, 2014

(30) Foreign Application Priority Data

Mar. 29, 2013 (CN) ..... 2013 1 0110336

(51) Int. Cl.
*B25B 13/46* (2006.01)

(52) U.S. Cl.
CPC ..... *B25B 13/463* (2013.01)

(58) Field of Classification Search
CPC .... B25B 13/461; B25B 13/462; B25B 13/463
USPC ..... 81/62–63.2
See application file for complete search history.

(56) References Cited

U.S. PATENT DOCUMENTS

| | | | | |
|---|---|---|---|---|
| 4,862,775 | A | 9/1989 | Chow | |
| 7,114,415 | B1 * | 10/2006 | Chiang | B25B 13/463 81/60 |
| 7,162,937 | B1 * | 1/2007 | Weng | B25B 13/463 81/63 |
| 8,042,433 | B2 | 10/2011 | Chu | |
| 8,485,069 | B1 * | 7/2013 | Chen | B25B 13/463 81/60 |
| 9,032,845 | B2 * | 5/2015 | Lin | B25B 13/463 81/61 |
| 2006/0156868 | A1 * | 7/2006 | Chen | B25B 13/463 81/63.2 |
| 2014/0208897 | A1 * | 7/2014 | Kao | B25B 13/463 81/63 |

FOREIGN PATENT DOCUMENTS

| | | | |
|---|---|---|---|
| CN | 2504039 | Y | 8/2002 |
| CN | 2510240 | Y | 9/2002 |
| CN | 101672567 | A | 3/2010 |

* cited by examiner

*Primary Examiner* — David B Thomas
(74) *Attorney, Agent, or Firm* — Muncy, Geissler, Olds & Lowe, P.C.

(57) ABSTRACT

A ratchet handle includes a detent. A front part of the detent has a first meshing portion and a second meshing portion to mesh with a ratchet gear. An accommodation recess is provided between the first meshing portion and the second meshing portion. An auxiliary member is provided in the accommodation recess. The auxiliary member has a curved surface corresponding to an outer contour of the ratchet gear. The ratchet handle further includes an operating device. The operating device is operated to turn the detent so as to control the first meshing portion or the second meshing portion to mesh with the ratchet gear. The detent of the present invention is turned with less noise and moved stably.

10 Claims, 7 Drawing Sheets

RATCHET HANDLE

BACKGROUND OF THE INVENTION

1. Field of the Invention

The present invention relates to a ratchet handle, and more particularly to a ratchet handle having a ratchet gear which is convenient to adjust its direction.

2. Description of the Prior Art

A conventional ratchet having a reversing structure comprises a wrench body. The wrench body has an axial trough to receive a ratchet gear and a control trough communicating with the axial trough. A detent member is provided in the control trough to mesh with the ratchet gear. An operating member is provided in a pivot trough to bring movement of a pin. The pin is biased by a spring to get contact with the detent member for the user to change the direction of the operating member to operate the detent member, so that the turning direction of the ratchet gear is changed to tighten or loosen a workpiece conveniently. The pin is used to operate the detent member for changing the turning direction of the ratchet gear and stopped by the trough wall of the control trough to fix its position so that the operating member is fixed in the pivot trough, preventing the parts from disengaging from the wrench body.

Because the contact area of the detent and the ratchet gear is less, the ratchet gear will cause a loud noise during turning. Besides, the force applied to the ratchet gear is a point force so the ratchet wrench may be damaged easily.

Accordingly, the inventor of the present invention has devoted himself based on his many years of practical experiences to solve these problems.

SUMMARY OF THE INVENTION

The primary object of the present invention is to provide a ratchet handle to overcome the shortcomings of the prior art.

In order to achieve the aforesaid object, the ratchet handle of the present invention comprises a handle and a detent. A front part of the detent has a first meshing portion and a second meshing portion to mesh with a ratchet gear. A first curved slide portion and a second curved slide portion are disposed behind the first meshing portion and the second meshing portion. An accommodation recess is provided between the first meshing portion and the second meshing portion. An auxiliary member is provided in the accommodation recess. The auxiliary member has a curved surface corresponding to an outer contour of the ratchet gear. A rear end of the auxiliary member has a first curved contact portion and a second curved contact portion. The handle has an axial trough at one end thereof. The ratchet gear is secured in the axial trough. One side of the axial trough is formed with a control trough to secure an operating device and the auxiliary member. The operating device controls the detent with the first meshing portion or the second meshing portion to mesh with the ratchet gear. After the first meshing portion meshes with the ratchet gear, the first curved slide portion is against the inner wall of the control trough and able to slide relative to the inner wall of the control trough, and the first curved contact portion is against the inner wall of the accommodation recess and able to slide relative to the accommodation recess. After the second meshing portion meshes with the ratchet gear, the second curved slide portion is against the inner wall of the control trough and able to slide relative to the control trough, and the second curved contact portion is against the inner wall of the accommodation recess and able to slide relative to the accommodation recess.

Preferably, the edges of the first curved contact portion and the second curved contact portion form an arc section of a first circle. The edges of the first curved slide portion and the second curved slide portion form two arc sections of a second circle. The first circle and the second circle are concentric circles. The edge of the inner wall of the control trough is located on the second circle, and the inner wall of the accommodation recess is located on the first circle.

Preferably, the operating device comprises a fixing seat. The fixing seat has a pivot trough thereon. An operating member has one end fitted in the pivot trough and another end able to engage with the detent. The operating device further comprises a spring. The spring is disposed in the pivot trough. The spring has two ends respectively positioned by the pivot trough and the operating member.

Preferably, a rear middle part of the detent has a trough. Two side walls of the trough respectively forms a first stop portion and a second stop portion. The operating member is moved in the trough to engage with a side wall of the groove so as to control the first meshing portion or the second meshing portion to mesh with the ratchet gear. When the first meshing portion engages with the ratchet gear, the fixing seat engages with the second stop portion. When the second meshing portion engages with the ratchet gear, the fixing seat engages with the first stop portion.

Preferably, the fixing seat has a fixing trough. The detent further has a detent support fitted in the fixing trough. The detent support is disposed in the fixing trough and rotatable relative to the fixing trough.

Preferably, the ratchet handle further comprises a stop member. The stop member is fixed to the bottom of the auxiliary member. A front end of the stop member has a curved surface to mate with the bottom of the ratchet gear.

Preferably, the stop member has a notch thereon to accommodate the bottom of the fixing seat. The notch and the bottom of the fixing seat have a curved shape.

Preferably, the fixing seat is connected with an operating handle. The fixing seat is adjusted to turn through the operating handle.

Preferably, the operating handle is exposed out of the control trough. The handle has a first limit portion and a second limit portion. The operating handle is disposed in a movement trough defined between the first limit portion and the second limit portion.

Preferably, the stop member has a curved rear. The rear of the stop member mates with a trough wall of the control trough and slides relative to the trough wall of the control trough.

The advantage of the present invention is that the ratchet wrench can be used to save time and labor by adjusting the operating device at different positions, without changing the working conditions.

When the detent is turned, the ratchet gear will be turned with less noise and moved stably because the auxiliary member mates with the outer contour of the ratchet gear and the stop member is against the bottom of the detent. When in use, the force applied to the ratchet gear will be transmitted to the handle evenly, namely, the force from the ratchet gear will be transmitted to the handle evenly through the auxiliary member and the stop member. The inner sides of the auxiliary member and the stop member are curved surface to bear great stress when applied with a force.

DETAILED DESCRIPTION OF THE PREFERRED EMBODIMENTS

Embodiments of the present invention will now be described, by way of example only, with reference to the accompanying drawings.

Figure 1:
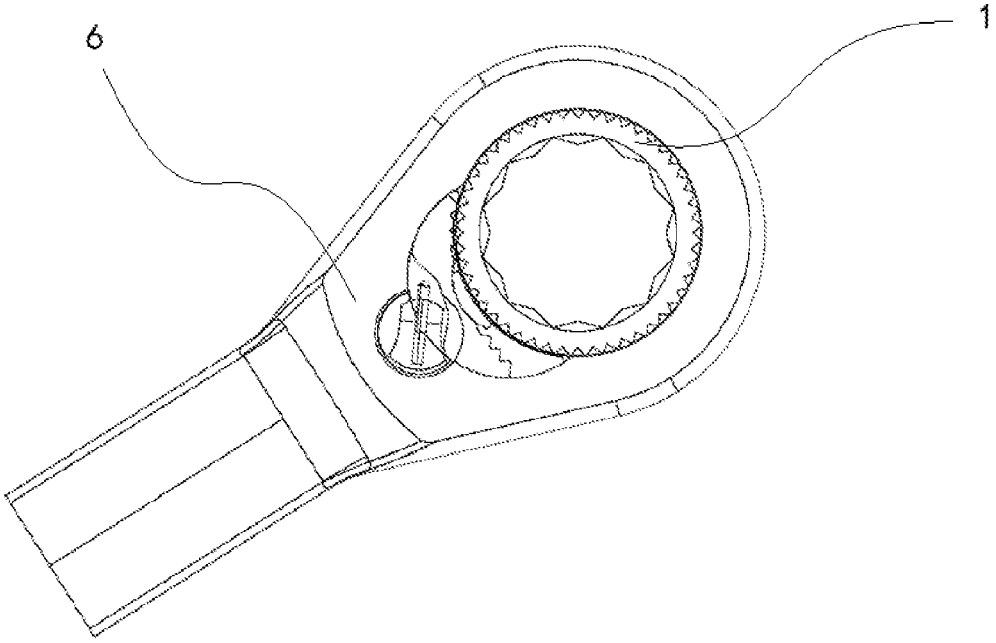
FIG. 1 is a schematic view of the present invention.
Figure 2:
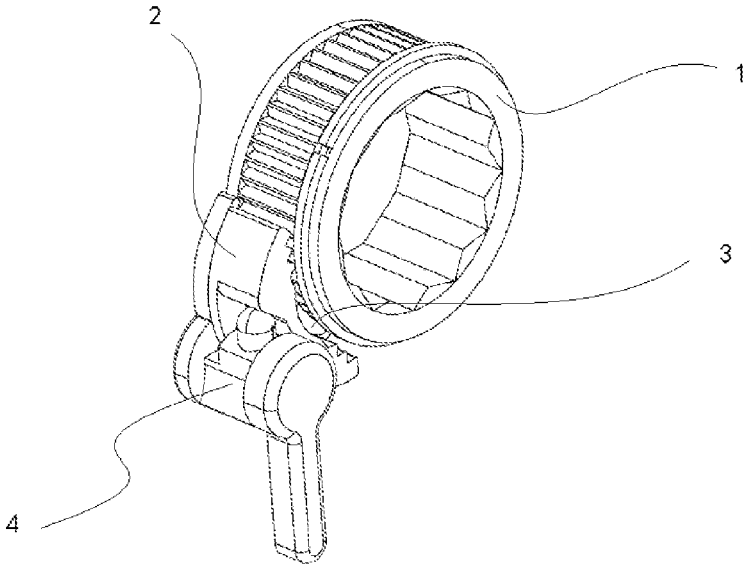
FIG. 2 is a perspective view of FIG. 1, without the handle.
Figure 3:
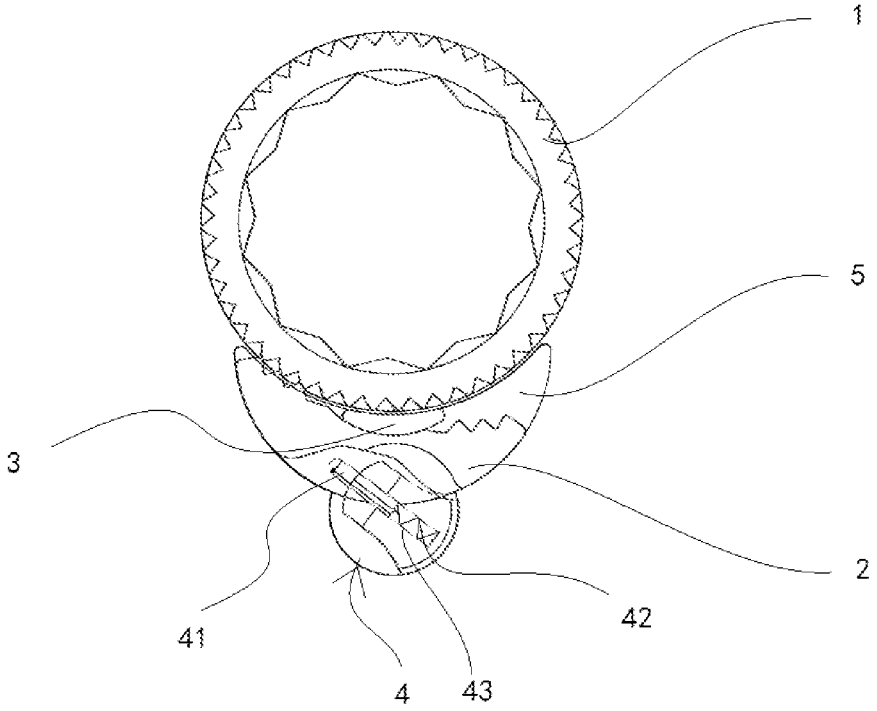
FIG. 3 is a sectional view of FIG. 2.

As shown in FIG. 1, FIG. 2 and FIG. 3, the ratchet handle according to a preferred embodiment of the present invention comprises a handle 6. The handle 6 has an axial trough at a front end thereof and a ratchet gear 1 fixed in the axial trough. The present invention further comprises a detent 2. The detent 2 is controlled by an operating device 4 to mesh with the ratchet through a first meshing portion or a second meshing portion.

Figure 9:
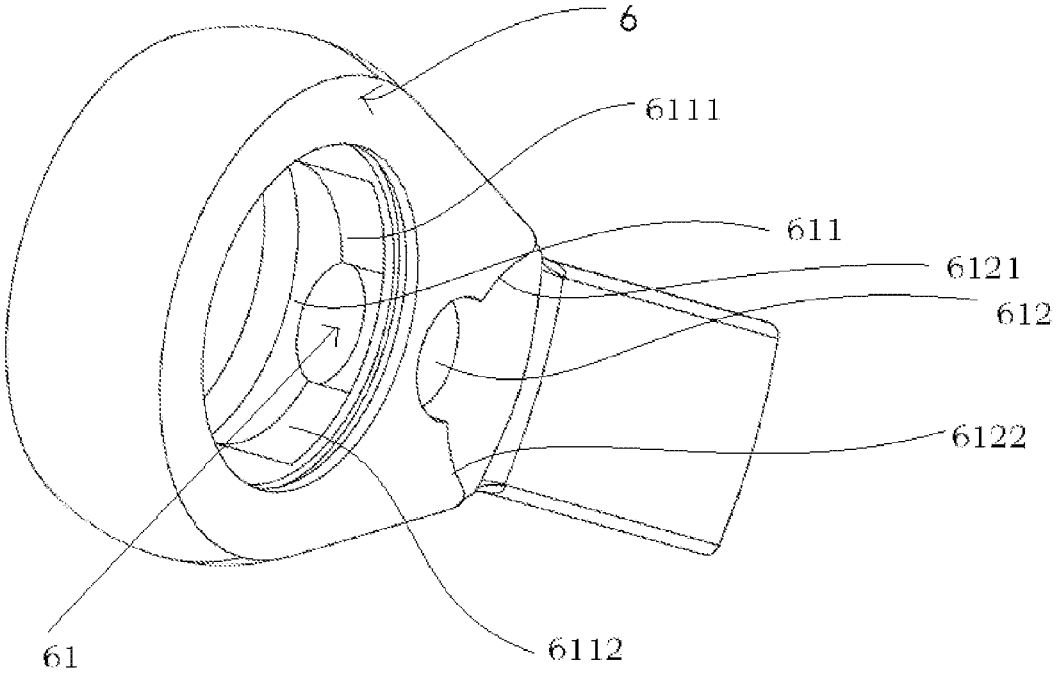
FIG. 9 is a schematic view showing the handle of the present invention.
Figure 10:
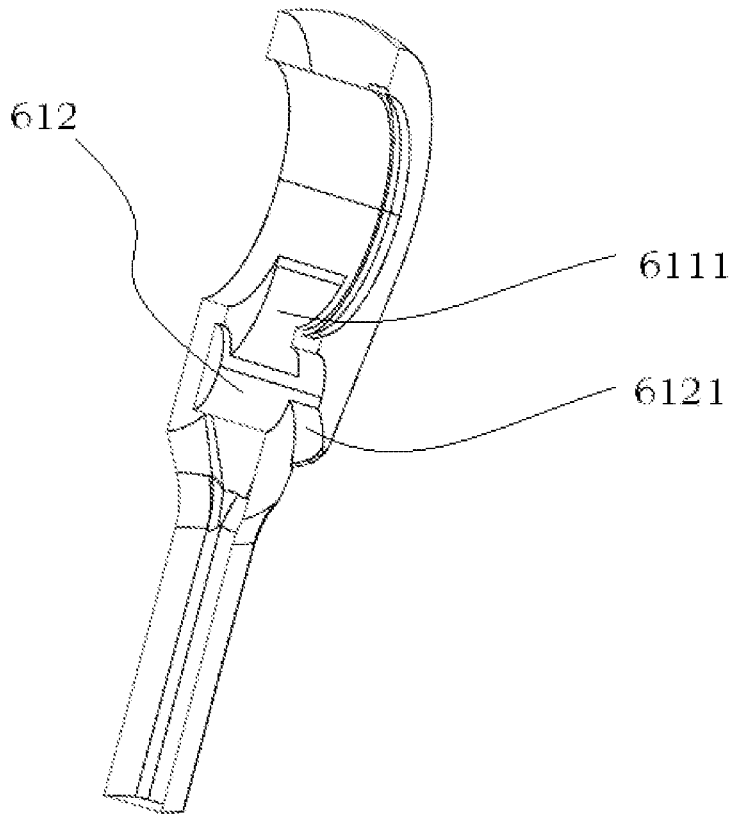
FIG. 10 is a sectional view of FIG. 9.

As shown in FIG. 9 and FIG. 10, the handle of the present invention has an axial trough at one end thereof and a control trough 61 at one side of the axial trough. The control trough 61 includes a first control trough 611 and a second control trough 612. The detent 2 is secured in the first control trough 611. The operating device is secured in the second control trough 612. The handle has a first limit portion 6121 and a second limit portion 6122 adjacent the second control trough 612. The operating handle of the operating device is exposed out of the second control trough and movable in a movement trough defined between the first limit portion and the second limit portion and confined by the first limit portion and the second limit portion.

Figure 6:
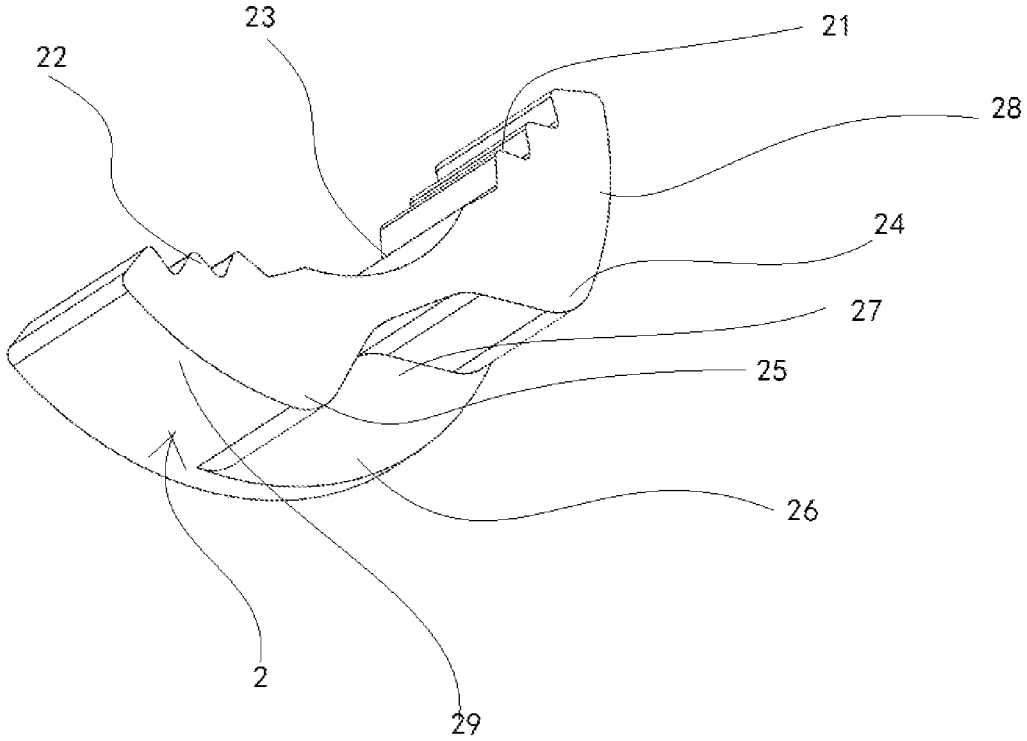
FIG. 6 is a schematic view showing the detent of FIG. 1.

As shown in FIG. 6, a front part of the detent 2 of the present invention has a first meshing portion 21, a second meshing portion 22 and an accommodation recess 23 between the first meshing portion 21 and the second meshing portion 22. A rear middle part of the detent 2 of the present invention has a trough 27. Two side walls of the trough 27 respectively form a first stop portion 25 and a second stop portion 24. A first curved slide portion 28 and a second curved slide portion 29 are disposed behind the first meshing portion 21 and the second meshing portion 22 and adjacent two ends of the trough 27. The detent 2 further has a detent support 26. The detent support 26 of the present invention is to form the bottom wall of the trough 27.

Figure 4:
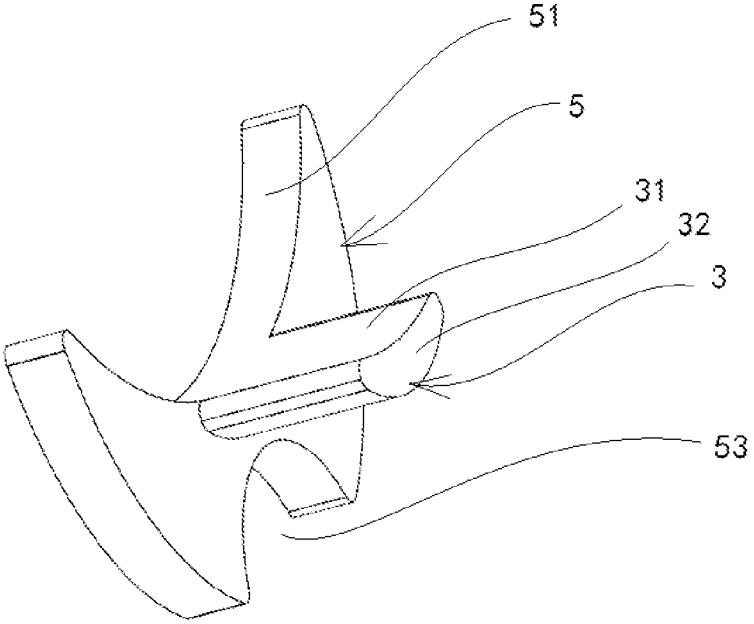
FIG. 4 is a schematic view showing the auxiliary member of FIG. 1.
Figure 5:
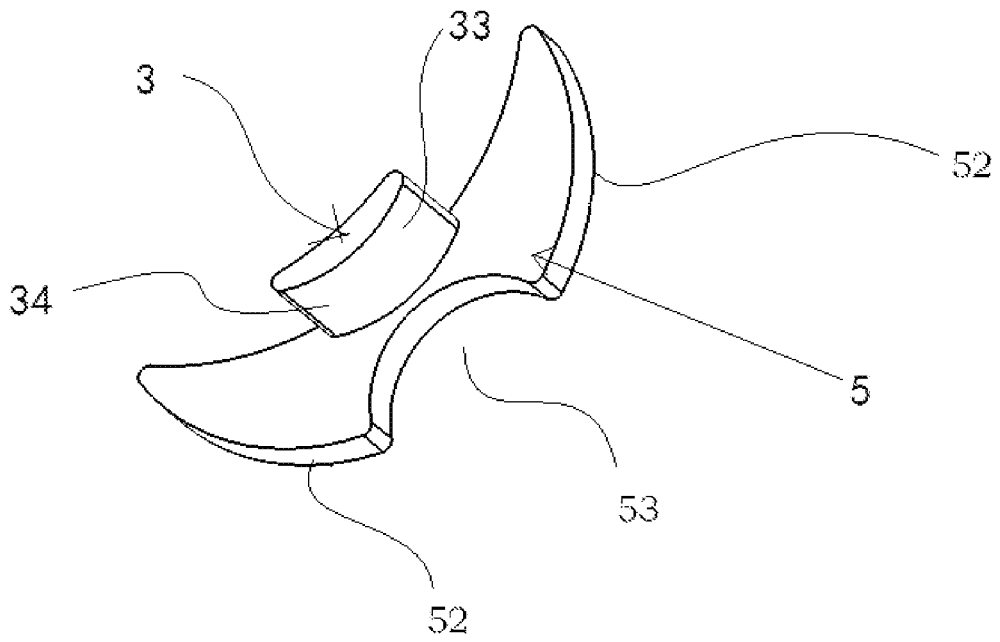
FIG. 5 is another schematic view of FIG. 4.

As shown in FIG. 4 and FIG. 5, the present invention further comprises an auxiliary member 3. The auxiliary member 3 comprises a main body 32. The front of the main body 32 has a curved surface 31 corresponding to an outer contour of the ratchet gear. The rear of the auxiliary member 3 has a first curved contact portion 33 and a second curved contact portion 34. The present invention further comprises a stop member 5. The stop member 5 is fixed to the bottom of the main body 32 of the auxiliary member 3. The front of the stop member 5 has a curved surface 51 to mate with the bottom of the ratchet gear 1. The stop member 5 has a curved notch 53 thereon. The stop member 5 has a curved rear 52. The rear of the stop member mates with the trough wall of the control trough and slides relative to the trough wall of the control trough. The arc of the rear of the stop member and the arc of the wall of the control trough have the same radius.

Figure 7:
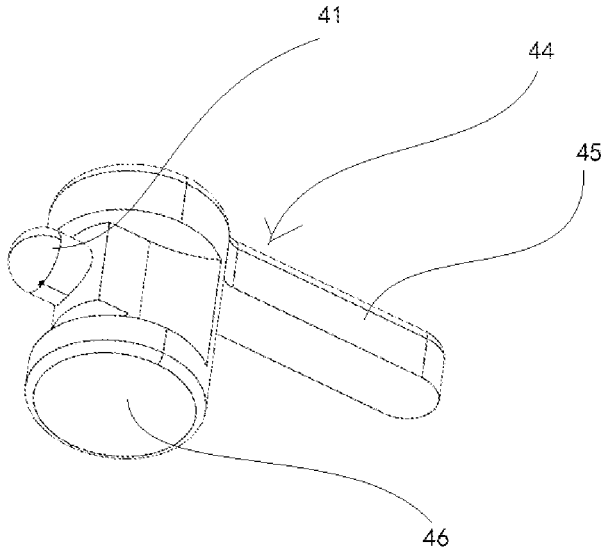
FIG. 7 is a schematic view showing the operating device of FIG. 1.
Figure 8:
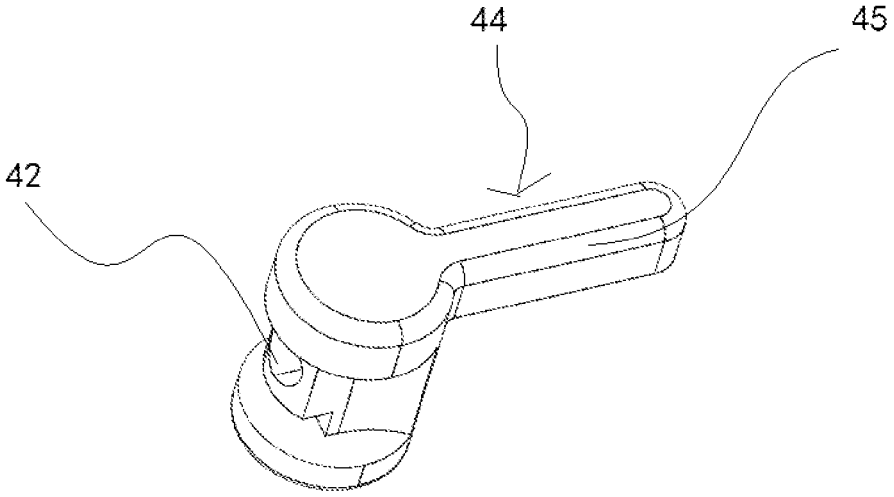
FIG. 8 is a perspective view of FIG. 7, without the operating member.

As shown in FIG. 7 and FIG. 8, the operating device 4 of the present invention is to control the detent with the first meshing portion 21 or the second meshing portion 22 to mesh with the ratchet gear 1. After the first meshing portion 21 meshes with the ratchet gear 1, the first curved slide portion 28 is against a first trough wall 6111 of the first control trough and able to slide relative to the first trough wall 6111 of the first control trough, and the first curved contact portion 33 is against the inner wall of the accommodation recess 23 and able to slide relative to the accommodation recess 23. After the second meshing portion 22 meshes with the ratchet gear 1, the second curved slide portion 29 is against a second trough wall 6112 of the first control trough and able to slide relative to the second trough wall 6112 of the first control trough, and the second curved contact portion 34 is against the inner wall of the accommodation recess 23 and able to slide relative to the accommodation recess 23. The operating device comprises a fixing seat 44. The fixing seat 44 has a pivot trough 42 thereon. An operating member 41 has one end fitted in the pivot trough 42 and another end able to engage with the detent. A spring 43 is provided in the pivot trough 42. One end of the spring 43 is limited through the pivot trough, and another end of the spring 43 is limited through the operating member 41. The fixing seat 44 is connected with an operating handle 45. The fixing seat 44 is adjusted to turn through the operating handle 45. The fixing seat 44 of the present invention further has a fixing trough 46.

The edges of the first curved contact portion 33 and the second curved contact portion 34 of the present invention form an arc section of a first circle. The edges of the first curved slide portion 28 and the second curved slide portion 29 form two arc sections of a second circle. The first circle and the second circle are concentric circles. The edges of the first trough wall 6111 and the second trough wall 6112 of the first control trough of the control trough are located on the second circle.

The operating handle of the present invention is exposed out of the control trough. The handle has a first limit portion 6121 and a second limit portion 6122. The operating handle is movable in a movement trough defined between the first limit portion and the second limit portion and confined by the first limit portion and the second limit portion.

As shown in FIG. 1 and FIG. 2, the detent 2 of the present invention is disposed at the exterior of the ratchet gear 1. The auxiliary member 3 is disposed inside the accommodation recess 23 at the middle of the detent 2. The rear of the auxiliary member 3 engages with the detent 2. The curved surface 31 at the front of the auxiliary member engages with the ratchet gear 1. The stop member 5 is against the bottom of the detent 2. The detent support 26 is disposed in the fixing trough 46 and rotatable relative to the fixing trough. The operating member 41 of the operating device is biased by the spring 43 to extend out of the pivot trough 42 and engage with the detent 2. The bottom of the fixing seat 44 is secured in the notch 53 of the stop member 5.

Figure 11:
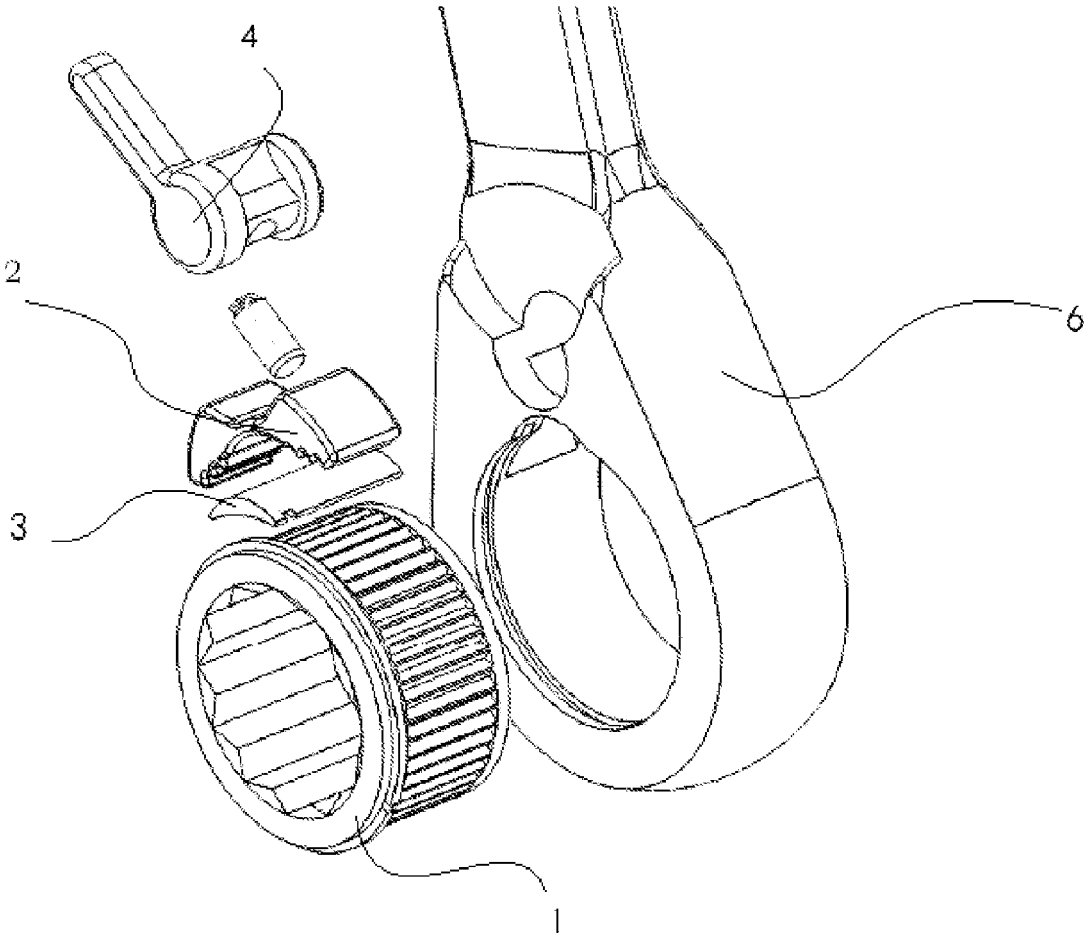
FIG. 11 is a schematic view of the structure explosion second embodiment of the invention.

As shown in FIG. 11, the schematic view of a second embodiment of the invention, the difference with the first embodiment of the invention is that the bottom of auxiliary member does not contain the stop member.

When in use, the fixing seat is driven to turn through the operating handle, and the detent support 26 of the detent is moved in the fixing trough of the fixing seat. The bottom of the fixing seat is moved in the notch of the stop member. The bottom of the fixing seat and the notch of the stop member are curved so as to decrease friction when turned. During turning, the operating member is moved in the trough. When the operating member is moved to the middle of the trough, the spring will be compressed to retract into the pivot trough. When the operating member is moved to pass the middle of the trough, the operating member biased by the spring will be moved to engage with the second stop portion at the side wall of the trough. This moment, the first meshing portion of the detent meshes with the ratchet gear, and the fixing seat engages with the first stop portion, and the first curved contact portion is against the accommodation recess, and the first curved slide portion is against the first trough wall of the first control trough. During the same procedure, the operating member is driven by the operating handle to move in the trough. When the operating member is moved to the middle of the trough, the operating member will compress the spring to retract into the pivot trough. When the operating member is moved to pass the middle of the trough, the operating member biased by the spring will be moved to engage with the first stop portion at the side wall of the trough. This moment, the second meshing portion of the detent meshes with the ratchet gear, and the fixing seat engages with the first stop portion, and the second curved contact portion is against the accommodation recess, and the second curved slide portion is against the second trough wall of the first control trough. When the detent is turned, the ratchet gear will be turned with less noise and moved stably because the auxiliary member mates with the outer contour of the ratchet gear and the stop member is against the bottom of the detent. When in use, the force applied to the ratchet gear will be transmitted to the handle evenly, namely, the force from the ratchet gear will be transmitted to the handle evenly through the auxiliary member and the stop member. The first curved slide portion and the first trough wall of the first control trough as well as the second curved slide portion and the second trough wall of the first control trough are disposed on the concentric circle. The first curved contact portion and the second curved contact portion and the trough wall of the accommodation recess are disposed on the same concentric circle. Thus, all parts are always engaged during movement. When applied with a force, the force will be dispersed to bear great force; the rear of the stop member has a third contact portion and a four contact portion. Both the third contact portion and the four contact portion are against the control trough and can move relative to the control trough.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A ratchet handle, comprising a handle and a detent, a front part of the detent having a first meshing portion and a second meshing portion to mesh with a ratchet gear, a first curved slide portion and a second curved slide portion disposed behind the first meshing portion and the second meshing portion, an accommodation recess provided between the first meshing portion and the second meshing portion, an auxiliary member provided in the accommodation recess, the auxiliary member having a curved surface corresponding to an outer contour of the ratchet gear, a rear end of the auxiliary member having a first curved contact portion and a second curved contact portion; the handle having an axial trough at one end thereof, the ratchet gear being secured in the axial trough, one side of the axial trough being formed with a control trough to secure an operating device and the auxiliary member, the operating device controlling the detent with the first meshing portion or the second meshing portion to mesh with the ratchet gear; wherein after the first meshing portion meshes with the ratchet gear, the first curved slide portion is against an inner wall of the control trough and able to slide relative to the inner wall of the control trough, and the first curved contact portion is against an inner wall of the accommodation recess and able to slide relative to the accommodation recess; wherein after the second meshing portion meshes with the ratchet gear, the second curved slide portion is against the inner wall of the control trough and able to slide relative to the control trough, and the second curved contact portion is against the inner wall of the accommodation recess and able to slide relative to the accommodation recess.

2. The ratchet handle as claimed in claim 1, wherein edges of the first curved contact portion and the second curved contact portion form an arc section of a first circle; edges of the first curved slide portion and the second curved slide portion form two arc sections of a second circle, the first circle and the second circle are concentric circles; an edge of the inner wall of the control trough is located on the second circle, and the inner wall of the accommodation recess is located on the first circle.

3. The ratchet handle as claimed in claim 1, wherein the operating device comprises a fixing seat, the fixing seat having a pivot trough thereon, an operating member having one end fitted in the pivot trough and another end able to engage with the detent, the operating device further comprising a spring, the spring being disposed in the pivot trough, the spring having two ends respectively positioned by the pivot trough and the operating member.

4. The ratchet handle as claimed in claim 1, wherein a rear middle part of the detent has a trough, two side walls of the trough respectively forming a first stop portion and a second stop portion, the operating member being moved in the trough to engage with a side wall of the groove so as to control the first meshing portion or the second meshing portion to mesh with the ratchet gear, wherein when the first meshing portion engages with the ratchet gear, the fixing seat engages with the second stop portion, wherein when the second meshing portion engages with the ratchet gear, the fixing seat engages with the first stop portion.

5. The ratchet handle as claimed in claim 3, wherein the fixing seat has a fixing trough, the detent further having a detent support fitted in the fixing trough, the detent support being disposed in the fixing trough and rotatable relative to the fixing trough.

6. The ratchet handle as claimed in claim 1, further comprising a stop member, the stop member being fixed to a bottom of the auxiliary member, a front end of the stop member having a curved surface to mate with a bottom of the ratchet gear.

7. The ratchet handle as claimed in claim 6, wherein the stop member has a notch thereon to accommodate a bottom of the fixing seat, the notch and the bottom of the fixing seat having a curved shape.

8. The ratchet handle as claimed in claim 7, wherein the fixing seat is connected with an operating handle, the fixing seat being adjusted to turn through the operating handle.

9. The ratchet handle as claimed in claim 8, wherein the operating handle is exposed out of the control trough, the handle having a first limit portion and a second limit portion, the operating handle being disposed in a movement trough defined between the first limit portion and the second limit portion.

10. The ratchet handle as claimed in claim 6, wherein the stop member has a curved rear, the rear of the stop member mating with a trough wall of the control trough and sliding relative to the trough wall of the control trough.

* * * * *